US005257569A

United States Patent [19]

Santarossa

[11] Patent Number: 5,257,569

[45] Date of Patent: Nov. 2, 1993

[54] APPARATUS FOR MANUFACTURE OF VEHICLE WHEELS

[75] Inventor: Walter A. Santarossa, Bowling Green, Ky.

[73] Assignee: Motor Wheel Corporation, Lansing, Mich.

[21] Appl. No.: 890,799

[22] Filed: Jun. 1, 1992

[51] Int. Cl.[5] ..... B26D 7/02

[52] U.S. Cl. ..... 83/182; 29/894.32; 83/466; 279/123

[58] Field of Search ..... 279/123, 126, 114, 121; 83/182, 458, 466; 72/335, 327; 29/894.325, 894.32

[56] References Cited

U.S. PATENT DOCUMENTS

| | | | |
|---|---|---|---|
| 2,094,225 | 9/1937 | Tuttle | 279/123 X |
| 3,833,232 | 9/1974 | Behrens | 279/123 |
| 3,834,212 | 9/1974 | Roper | 72/354 |
| 3,855,683 | 12/1974 | Phillipp | 29/159.01 |
| 3,855,837 | 12/1974 | Phillipp | 72/354 |
| 4,074,408 | 2/1978 | Davis | 29/159.01 |
| 4,573,338 | 3/1986 | Daudi | 29/894.32 X |
| 4,585,240 | 4/1986 | Giffen | 279/126 X |
| 4,646,434 | 3/1987 | Daudi | 29/802 |
| 4,733,448 | 3/1988 | Daudi | 29/894.32 |
| 4,736,611 | 4/1988 | Daudi | 29/894.32 X |
| 4,819,472 | 4/1989 | Daudi | 72/335 |

*Primary Examiner*—Frank T. Yost
*Assistant Examiner*—Kenneth E. Peterson
*Attorney, Agent, or Firm*—Barnes, Kisselle, Raisch, Choate, Whittemore & Hulbert

[57] ABSTRACT

Apparatus for forming the bolt openings and/or the center-pilot opening in a vehicle wheel that includes a circumferential array of locating jaws for engaging and locating the rim portion of the wheel. An upper die is reciprocable for forming at least one mounting opening on a first axis in the disc portion of a wheel engaged by the locating jaws. The locating jaws are movable between a first or outer position, and a second or inner position radially inward of the outer position and in which the locating jaws engage the rim portion of the wheel positioned within the locating jaws. A ring mechanism surrounds the first axis and is disposed for radial abutment by the mechanism for moving the locator jaws at the second or inner position of the locator jaws so as to define the second or inner position of the locating jaws concentrically with each other on a second axis, which may be either concentric with or eccentric to the first axis.

26 Claims, 5 Drawing Sheets

APPARATUS FOR MANUFACTURE OF VEHICLE WHEELS

The present invention relates to the art of vehicle wheel manufacture, and more particularly to an apparatus for forming mounting openings in the disc of a vehicle wheel at desired concentricity or eccentricity with respect to the wheel rim bead seats.

BACKGROUND OF THE INVENTION

A problem long-standing in the automotive field lies in production of pneumatic tire and wheel assemblies that, when assembled and operated on a vehicle, run true about their axis of rotation. Forces generated by any circumferential variations in the tire carcass and/or out-of-round condition in the tire or wheel cause vibrations, which in turn lead to dissatisfied customers and significant warranty claims against automobile manufacturers. The present trend among manufacturers toward higher tire inflation pressures, smaller vehicles and tighter vehicle suspensions to improve fuel economy accentuates this problem, so that uniformity of radial run-out and force variations of the tire and wheel assembly has become more critical than in the past.

Vehicle wheels conventionally include a circular array of disc bolt openings adapted to receive studs for fastening the wheel to a vehicle, and a center-pilot opening adapted to be received over the wheel hub. It has been and remains conventional practice in the industry to attempt to form the bolt circle and center-pilot openings coaxially with each other and with the rim bead seats, with the goal thus being a perfect true-running wheel. A number of techniques have been proposed for accomplishing this result, including formation of the bolt and center openings with a single tool while locating off of the bead seats, machining the center opening while locating off of preformed bolt openings, and/or circumferentially permanently deforming the rim bead seats while locating off of the bolt and/or center-pilot opening.

Daudi et al U.S. Pat. Nos. 4,279,287, 4,354,407 and 4,573,338 all assigned to the assignee hereof and incorporated by reference herein, depart from the conventional practice of attempting to form a true-running wheel, and address the problem of radial run-out and/or radial force variation in a pneumatic tire and wheel assembly by intentionally forming the bolt openings and/or center-pilot opening in the wheel disc at the time of wheel manufacture on an axis that is eccentric to the average axis of the rim bead seats. (It is understood in the art that the average axis of the bead seats is the average axis of one bead seat averaged with the average axis of the other bead seat, for example by measuring the bead seats simultaneously.) This eccentricity is in a direction and amount that is predetermined to locate the low point or high point of the first harmonic of bead seat radial run-out circumferentially adjacent to a selected location on the wheel rim. In the preferred embodiments, the low point of the first harmonic of bead seat radial run-out lies substantially within a quadrant centered on the valve stem opening in the rim. A pretested tire having the location of the high point of the first harmonic of radial force variation marked thereon may then be assembled to the wheel such that the respective tire and wheel harmonics are complimentary and thereby tend to cancel each other.

In the preferred wheel forming apparatus disclosed in the abovenoted Daudi et al U.S. Patents, the bolt and center-pilot openings are formed by separate punches fixedly mounted on a single punch assembly that substantially simultaneously punch-forms all the mounting openings in a wheel disc while the wheel is located by fixturing the same about the rim bead seats. Daudi U.S. Pat. Nos. 4,736,611 and 4,819,472, also incorporated by reference herein, disclose an improved method and apparatus for forming the bolt and center-pilot openings in which a preformed wheel is engaged and fixtured around the rim bead seats with the inboard disc face resting on a lower die assembly and without plastic deformation to the rim or disc. An upper die assembly having an array of bolt hole punches is moved into piercing and coining engagement with the disc to form the bolt openings. Continued motion of the upper die assembly pushes the disc and lower die assembly into shearing engagement with a center punch that forms the center-pilot opening. The axis of the bolt openings and/or center-pilot opening and/or bead seats may be concentric with or eccentric to each other.

A problem with the apparatus disclosed in the abovenoted patents lies in the fact that the several locators that engage the rim bead seats for defining the location of the average bead seat axis of the wheel relative to the tooling set-up during the forming operation require individual adjustment by relatively skilled technicians. Whether forming the mounting openings (i.e., the bolt openings and/or the center-pilot opening) concentric with or eccentric to the rim bead seats, it is desirable that the array of bead-seat-engaging surfaces of the locating jaws be substantially concentric with each other when engaging the rim bead seats during the forming operation. Added to this, of course, is the complexity of adjusting the individual locating jaws so that their average axis is either precisely concentric with the hole-forming mechanism, or eccentric thereto by a precise and desired amount.

It is therefore a general object of the present invention to provide improved apparatus for forming mounting openings in vehicle wheels having facility for easy, more precise and economical adjustment of concentricity/eccentricity of the mounting openings with respect to the rim bead seats.

SUMMARY OF THE INVENTION

The present invention is directed to apparatus for forming least one mounting opening - i.e., the bolt openings and/or the center-pilot opening - in a vehicle wheel that includes a rim portion and a disc portion that internally spans the rim portion for mounting the wheel to a vehicle. The apparatus includes a circumferential array or series of locating jaws for engaging and locating the rim portion of the wheel, preferably by engaging one or both of the rim bead seats. The locating jaws are movable between a first or outer position, and a second or inner position radially inward of the outer position and in which the locating jaws engage the rim portion of the wheel positioned within the locating jaws. An upper die is reciprocable for forming at least one mounting opening on a first axis in the disc portion of a wheel engaged by the locating jaws. Preferably, the bolt openings are formed by punches carried by the upper die, and the center-pilot opening may be likewise formed by a punch carried by the upper die or by an opposing punch carried by the lower die. A ring mechanism surrounds the first axis and is disposed for radial abutment with the mechanism for moving the locator jaws to the second or inner position of the locator jaws so as to define the second or inner position of the bead-seat-engaging surfaces of the locator jaws concentrically with each other on a second axis, which may be either concentric with or eccentric to the first axis. The mechanism for moving the locator jaws against the ring is constructed for elastically moving and holding the jaws against the ring so as to accommodate differing ring adjustments and/or size.

In the preferred embodiment of the invention, the ring mechanism comprises a pair of radially internested rings each having a predetermined preferably equal amount of eccentricity built into the relationship relative to one another of the inner and outer peripheries of the rings. The inner ring has a radially inwardly directed surface or inner periphery that surrounds, and preferably is concentric with, the first axis of the apparatus. The radially outwardly facing surface or outer periphery of the first or inner ring has a first predetermined eccentricity with respect to the inner peripheral surface of the inner ring. The radially inwardly oriented surface or inner periphery of the second or outer ring is slidably coupled to and about the outer periphery of the inner ring, and the outer periphery of the outer ring is eccentric to the inner periphery of the outer ring. Preferably, all of the ring peripheral surfaces are cylindrical, with axes eccentric as described. The locating jaws are driven into abutment with the outer ring outer periphery thereby to clamp the wheel bead seats. The axis of the outer ring outer periphery thus defines the second axis of the apparatus, which corresponds to the average axis of the bead seat locating jaws.

The inner and outer rings are individually and independently adjustable, preferably by means of respective electric motors or motor mechanisms coupled by gears to the respective rings. To facilitate either automatic or manual adjustment of the ring positions, and thus adjustment of the average axis of the locators with respect to the axis of the mounting openings formed by the die mechanism, sensors are operatively coupled to the outer ring at 90° spacing from each other, and are coupled to suitable electronics for determining and displaying position of the axis of the outer ring surface with respect to the axis of apparatus reciprocation. A control mechanism may also receive input information from an operator or the like indicative of desired concentricity/eccentricity between these axes, and supply corresponding control segments to the motors that drive the rings. Since the eccentricities of the outer surfaces of each ring with respect to the corresponding inner surface are preferably identical, the outer surface of the outer ring may be adjusted to be either concentric with or eccentric to the axis of the apparatus for forming the mounting openings.

In the preferred embodiments of the invention, the wheel locating jaws are driven radially inwardly into clamping engagement with the rim bead seats by an initial downward motion of the upper die on which the bolt opening punches are mounted, and by a roller-cam arrangement of the type disclosed in above-noted U.S. Pat. No. 4,736,611. In these embodiments, the concentric rings may be positioned either for stop engagement with the slides on which the locator jaws are mounted immediately beneath the locator jaws, or on the cam mechanism for moving the jaws during descent of the upper die. In another embodiment of the invention, the wheel locating jaws are mounted on slides that are coupled to individual fluid cylinders, such as hydraulic cylinders, for individual movement of the jaws independently of motion of the upper die.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
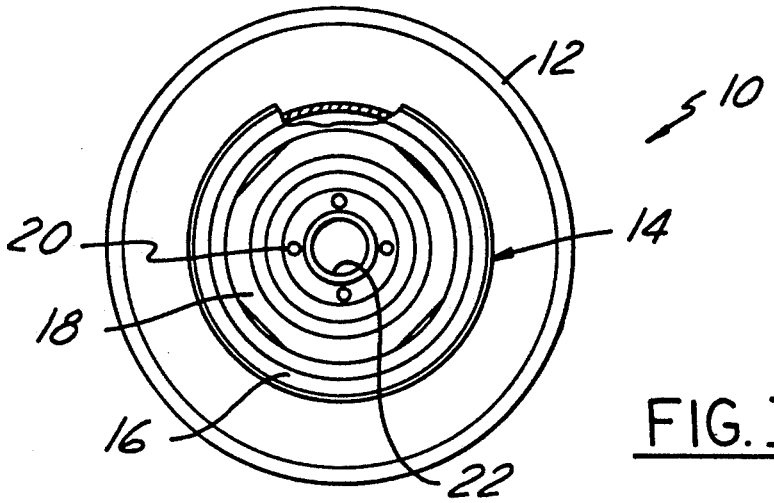
FIG. 1 is a fragmentary outboard elevational view of a vehicle tire and wheel assembly that includes a vehicle wheel manufactured in accordance with the present invention.

FIG. 1 illustrates a pneumatic tire and wheel assembly 10 as comprising a pneumatic tire 12 mounted on a wheel 14. Wheel 14 includes a rim portion 16 having axial spaced outboard and inboard bead seats on which the toes of tire 12 are mounted, and a disc portion 18 affixed to and positioned within rim 16. Disc 18 has a circular array of bolt openings 20 surrounding a center-pilot opening 22. The wheel 14 illustrated in FIG. 1 is a so-called stamped steel wheel of the type in which the rim and disc portions are separately formed from steel sheet stock, and are assembled to each other to form the wheel. It will be recognized as the description unfolds, however, that the invention in its broadest aspects is by no means limited specifically to manufacture of stamped steel wheels, but may be employed for forming mounting openings by drilling, boring, reaming or the like in cast, forged or wrought aluminum wheels, molded fiber/resin composite wheels, etc. Likewise, although the invention is illustrated in conjunction with a wheel of geometry suitable for rear-wheel drive vehicles, it will be recognized that the invention may be employed with equal facility in conjunction with wheels for front-wheel drive vehicles in which the central portion of the disc is disposed more outboard of the rim center plane. Thus, the specific wheel construction and geometry shown in the drawings is for illustrative purposes only.

Figure 2:
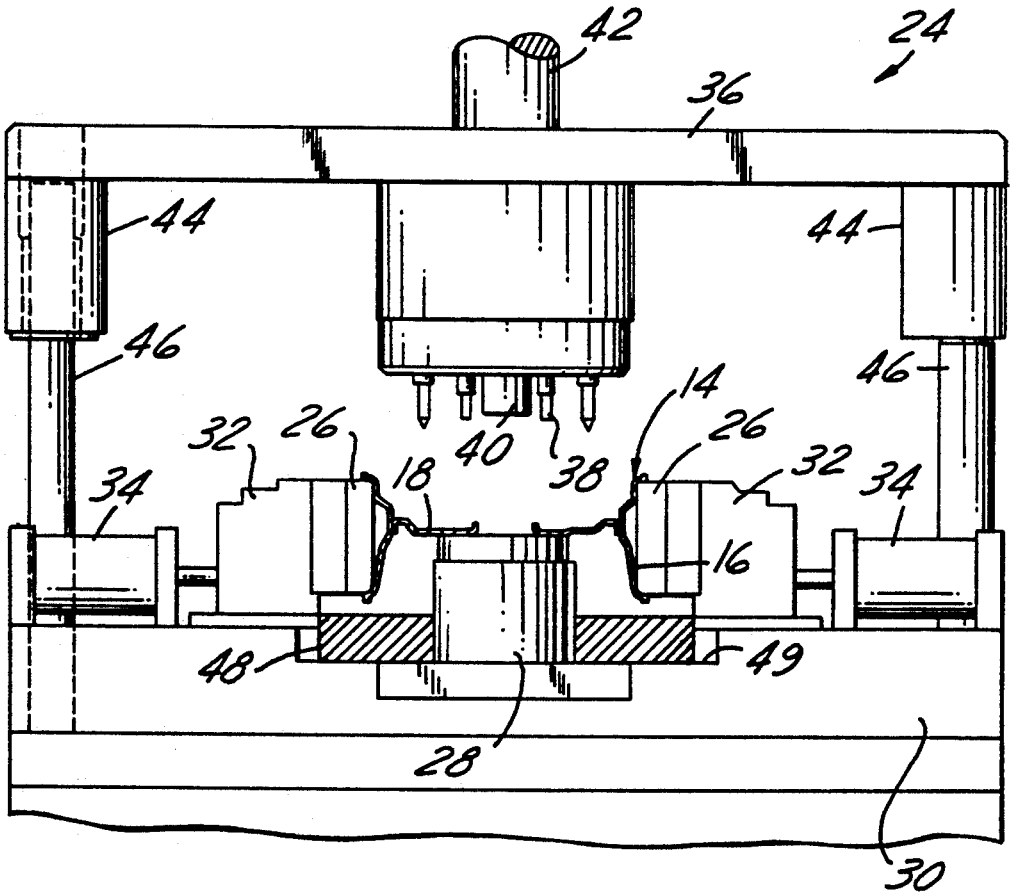
FIG. 2 is a fragmentary elevational view bisecting a first embodiment of apparatus for forming mounting openings in a vehicle wheel in accordance with the present invention.

FIG. 2 illustrates one apparatus 24 for implementation of the present invention. A plurality of wheel locating and fixturing jaws 26 are disposed in a circumferential array surrounding a lower die 28 carried by a die base 30. Each of the locator jaws 26 is mounted on an associated slide 32 carried by base 30 for movement radially inwardly and outwardly with respect to die 28. Each slide 32 is coupled to an associated fluid (e.g., hydraulic) cylinder 34 on base 30. An upper die 36 carries a plurality of punches 38 for punching and coining bolt openings 20 (FIG. 1) in disc 18, and a center punch 40 for punching or forming the center-pilot opening 22 of disc 18. Upper die 36 is coupled to a ram 42 for reciprocating the upper die downwardly and upwardly with respect to lower die 28 and base 30. Upper die 36 is guided by the sleeves 44 slidably received over the guide posts 46 on base 30. Upper die 36 is thus of the type illustrated in above-noted U.S. Pat. Nos. 4,279,287 and 4,354,407 having bolt and center punches 38, 40 thereon. As noted above, U.S. Pat. Nos. 4,736,611 and 4,819,472 disclose modifications in which the center punch is disposed on lower die 28.

A stop ring 48 is removably and adjustably positioned within a depression 49 on base 30 surrounding lower die 28, and projects upwardly above the upper surface of base 30 for travel stopping engagement by slides 32 as the slides are moved radially inwardly by their associated cylinders 34. The radially outwardly oriented surface of ring 48 thus defines the axis of the array of bead-seat-clamping surfaces of locators 26, which in turn define the fixtured location of the average axis of the wheel rim bead seats engaged thereby. The outer surface of ring 48 may be either concentric with or eccentric to the axis of die 28 and punches 38, 40. The amount of eccentricity may be selected by using differing rings, and the direction (angle) of eccentricity may be selected by adjustably rotating ring 48 about the axes of die 28. The stroke of each cylinder 34 is such that the slides 32 firmly abut ring 48. Elasticity of fluid pressure with the several cylinders accommodates variations in diameter of ring 48 for differing rim sizes, as well as eccentricity of ring 48 with respect to the axis of punches 38 and/or 40. Thus, differing rings 48 are employed for differing rim diameters, and for differing concentricity/eccentricity specifications of mounting openings bead seats.

In operation, a preformed wheel 18 is moved into apparatus 20 manually or by a suitable conveyor (not shown), and is positioned with disc 18 seated loosely on die 28 and with locators 26 and slides 32 retracted radially outwardly clear of the wheel rim 16. The locators and slides are then moved radially inwardly by associated cylinders 34 so that locators 26 engage the wheel rim bead seats as shown in FIG. 2. The final inner or rim-engaging travel stop positions of the several slides 32 and locators 26 are defined by the radially outwardly oriented surface of stop ring 48 when abuttingly engaged by the several slides. The yieldable resiliency of the several fluid cylinders 34 hold the slides 32 in abutting engagement with ring 48. With wheel 18 so located and securely fixtured, upper die 36 is propelled downwardly by ram 42 so as to bring punches 38, 40 into forming engagement with the disc portion of wheel 18. Upper die 36 is then retracted by ram 42, slides 32 and locators 26 are retracted by fluid cylinders 34, and wheel 18 with mounting openings formed therein is removed manually or by suitable automated conveying apparatus.

Figure 3:
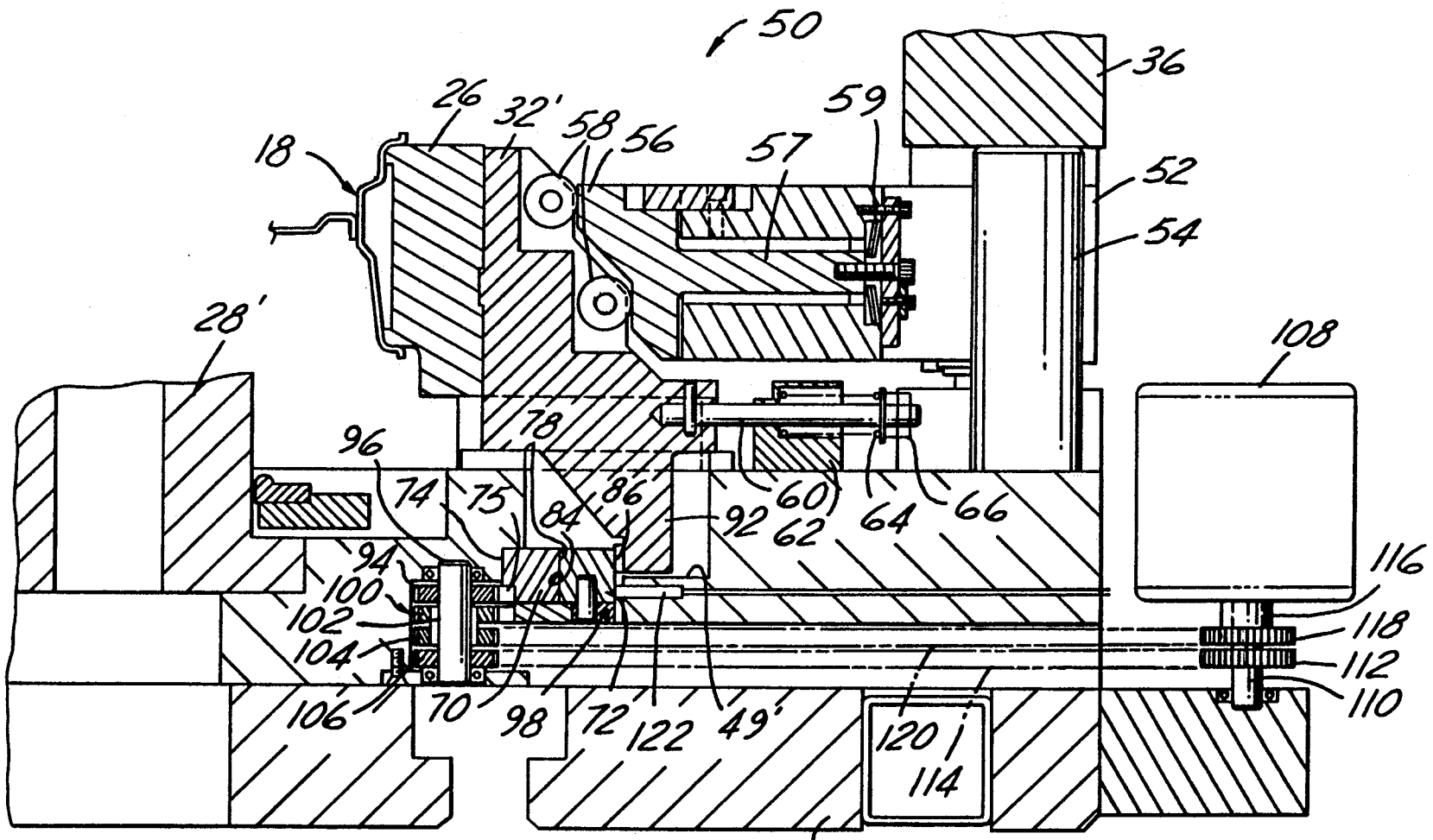
FIG. 3 is a fragmentary sectional view in side elevation of a second embodiment of apparatus for forming mounting openings in a vehicle wheel in accordance with a presently preferred embodiment of the invention.

FIG. 3 illustrates a second embodiment of apparatus 50 for forming mounting openings in wheel 18, and is the presently preferred embodiment of the invention. A circumferentially continuous actuator ring 52 is axially slidably carried by a circumferential array of fixed guide posts 54 that project upwardly from lower die base 30'. A plurality of circumferentially spaced actuator camming blocks 56 have shanks 57 radially slidably carried by ring 52, with blocks 56 projecting inwardly from the inner periphery of ring 52 in alignment with rollers 58 carried by respective slides 32'. Each block 56 has a pair of angulated or ramped lower inside cam surfaces for engaging a corresponding roller 58 and urging the associated slide 32' and jaw 26 radially inwardly as ring 52 is moved downwardly by abutment with upper die 36 as the upper die descents. A shaft 60 is affixed to slide 32' beneath ring 52, and projects radially outwardly therefrom slidably through a spring block 62 affixed to the upper surface of die base 30'. A coil spring 64 is captured in compression between block 62 and the jam nuts 66 on shaft 60 for biasing each associated slide 32' radially outwardly, and thereby retracting slides 32' and jaws 26 when upper die 36 and ring 52 ascend. To the extent thus far described, apparatus 50 is disclosed in above-noted U.S. Pat. Nos. 4,736,611 and 4,819,472, to which reference may be made for further details of structure and operation.

Figure 4:
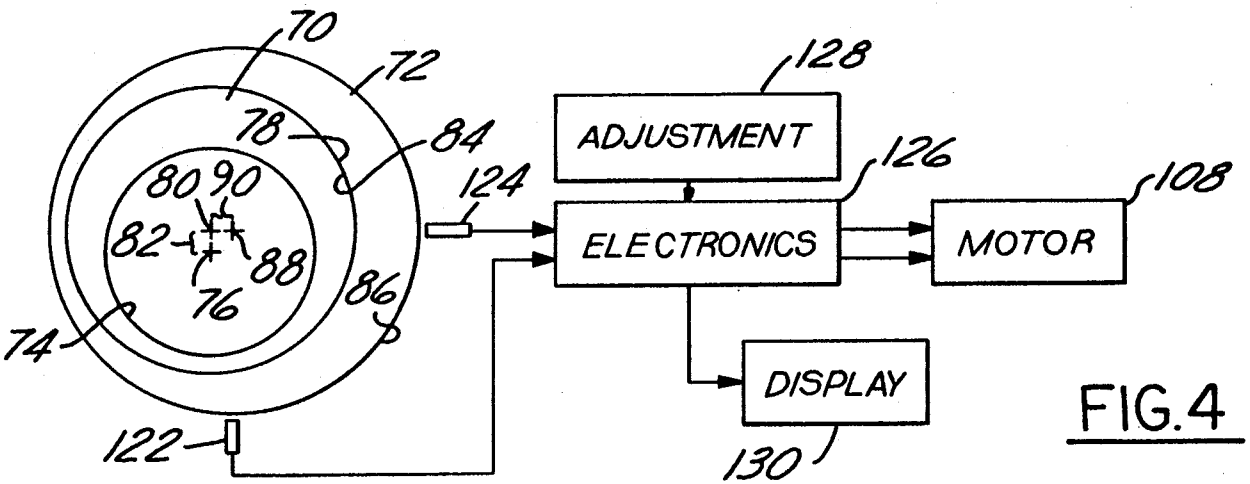
FIG. 4 is a functional block diagram of a control system, with exaggerated schematic of nested eccentric stop rings, that illustrates adjustment of the apparatus shown in FIG. 3.

A pair of radially internested inner and outer rings 70 and 72 are disposed within a pocket 49' on die base 30' surrounding lower die 28 and the axis of reciprocation of upper die 36. Inner ring 70 has a radially inwardly oriented inner peripheral surface 74 (FIGS. 3 and 4) on a cylinder of revolution with a central axis 76 (FIG. 4) that preferably is coaxial with the central axis of the punches 38 and/or 40 (FIG. 2) on upper die 36. The radially outwardly oriented outer peripheral surface 78 of inner ring 70 is likewise on a cylinder of revolution, but has a central axis 80 that is eccentric by the amount 82 (FIG. 4) to the axis 76 of the inner ring surface 74. (The eccentricities and ring geometries are greatly exaggerated in FIG. 4 for purposes of illustration and explanation.) The radially inwardly oriented inner peripheral surface 84 of outer ring 72 is likewise on a cylinder of revolution and is disposed in sliding engagement with outer peripheral surface 78 of inner ring 70, and thus has a central axis coincident at 80 with the central axis of inner ring surface 78. The outer peripheral surface 86 of outer ring 72 is on a cylinder of revolution having an axis 88 that is eccentric to axis 80 by the amount 90. Preferably, the amounts of eccentricities 82, 90 are equal, thereby permitting coincident positioning of axes 76, 88 through proper relative rotational adjustment of rings 70, 72. Inner peripheral surface 74 of inner ring 70 may be slidably guided by an outwardly facing surface of lower die 28', as shown in FIG. 3. A finger 92 (FIG. 3) depends from each slide 32 into pocket 49 for radially outward travel-stopping abutment with outer stop surface 86 of outer ring 72, thereby to establish the wheel fixturing travel limit, and hence the innermost position of slides 32' and locator jaws 26. Thus, as was the case in FIG. 2, the position of outer surface 86 of ring 72 determines the location of the average axis of the circular array of slides 32' and locators 26, and thus the fixtured location of the average axis of the rim bead seats of wheel 18. A set of spring washers 59 is captured in compression within ring 52 radially outwardly adjacent to and aligned with each shank 57 on each cam block 56. Washers 59 resiliently absorb lost motion of cam block 56 following engagement of slide finger 92 with ring stop surface 86. Thus, elasticity of spring washers 59 accommodates adjustment of eccentricities 82, 90 around axis 76.

Inner ring 74 has radially inwardly oriented internal gear teeth 75 that mesh with a spur drive gear 94 mounted on a shaft 96. Shaft 96 is rotatably mounted on die base 30' radially inwardly adjacent to rings 70, 72 and parallel to axis 76. Outer ring 72 is affixed to and carried by a support ring 98 that has an array of internal gear teeth that mesh with a spur drive gear 100. Spur gear 100 is affixed for rotation with, and carried by, a bearing 102 rotatable on shaft 96, as is a spur gear 104 parallel to gear 100. A spur gear 106 is affixed to shaft 96. Thus, spur gears 94, 106 and shaft 96 rotate conjointly, and spur gears 100, 104 are conjointly rotatable on bearing 102 coaxially with but independently of shaft 96. A dual-shaft electric motor 108 is mounted on lower die base 30' in radially outward parallel alignment with shaft 96. A first or inner shaft 110 of motor 108 is coupled by a gear 112 and a drive belt 114 to rotate spur gear 106 on shaft 96. The second or outer shaft 116 of motor 108 is coupled by a gear 118 and and a drive belt 120 to rotate spur gear 104 on bearing 102. Thus, motor 108 rotates inner ring 70 about axis 76 by means of shaft 110, gear 112, belt 114, gear 106, shaft 96 and gear 94. Motor 108 also rotates outer ring 72 about axis 80, independently of inner ring 70, by means of shaft 116, gear 118, drive belt 120, gear 104, bearing 102 and gear 100. Since rings 70, 72 are independently adjustable around axis 76 (FIG. 4), axis 88 of outer ring gear surface 86 may be adjusted to any desired position. The minimum eccentricity adjustment is equal to the difference between eccentricities 82, 90, preferably zero, and the maximum eccentricity adjustment is equal to the sum of eccentricities 82, 90. The dual-shaft motor may, of course, be replaced by separate single-shaft motors.

To facilitate adjustment of rings 70, 72, a pair of position sensors 122 (FIGS. 3 and 4) and 124 (FIG. 4) are mounted within die base 30' radially outwardly adjacent and opposed to outer stop surface 86 of ring 72. Sensors 122, 124 preferably comprise proximity sensors of the type that provide respective output signals as functions of proximity of ring surface 86 to the respective sensors. The sensors are positioned at 90° spacing around axis 76, and are connected to control electronics 126 that preferably comprises microprocessor-based electronics for determining position of axis 88 with respect to axis 76 as a function of the respective sensor output signals. Electronics 126 also receives an input signal from a suitable adjustment selection mechanism 128, such as an operator keyboard for example, and provides output signals to motor 108 for moving rings 70, 72 as a function of axis position desired by an operator. Electronics 126 are also coupled to a suitable display 130 for indicating to the operator position of axis 88 and/or the amount and direction of eccentricity of axis 88 with respect to axis 76.

Figure 5:
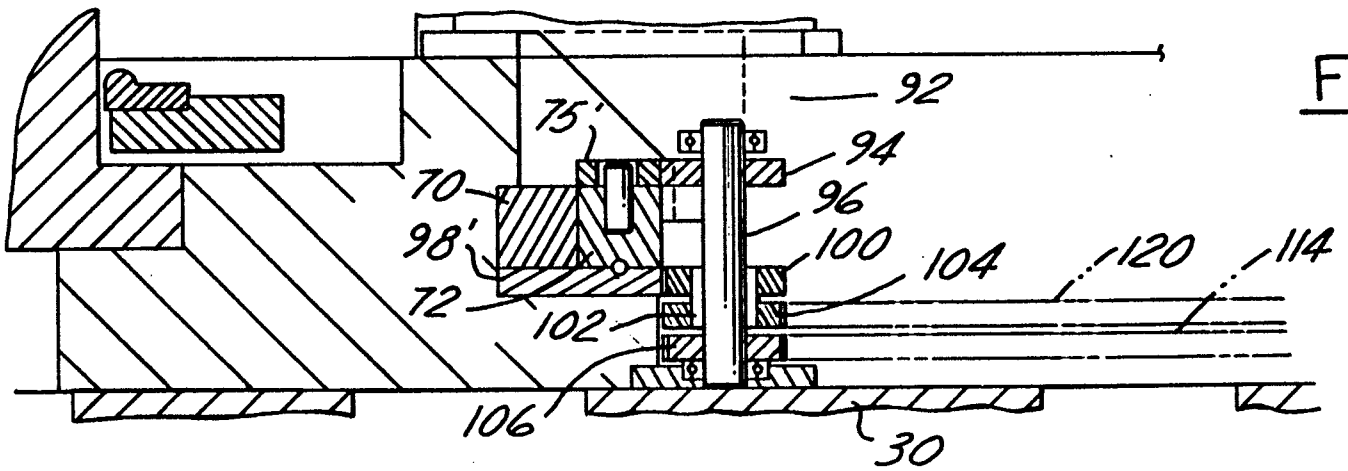
FIG. 5 is a fragmentary view of a modification to the apparatus of FIG. 3.
Figure 6:
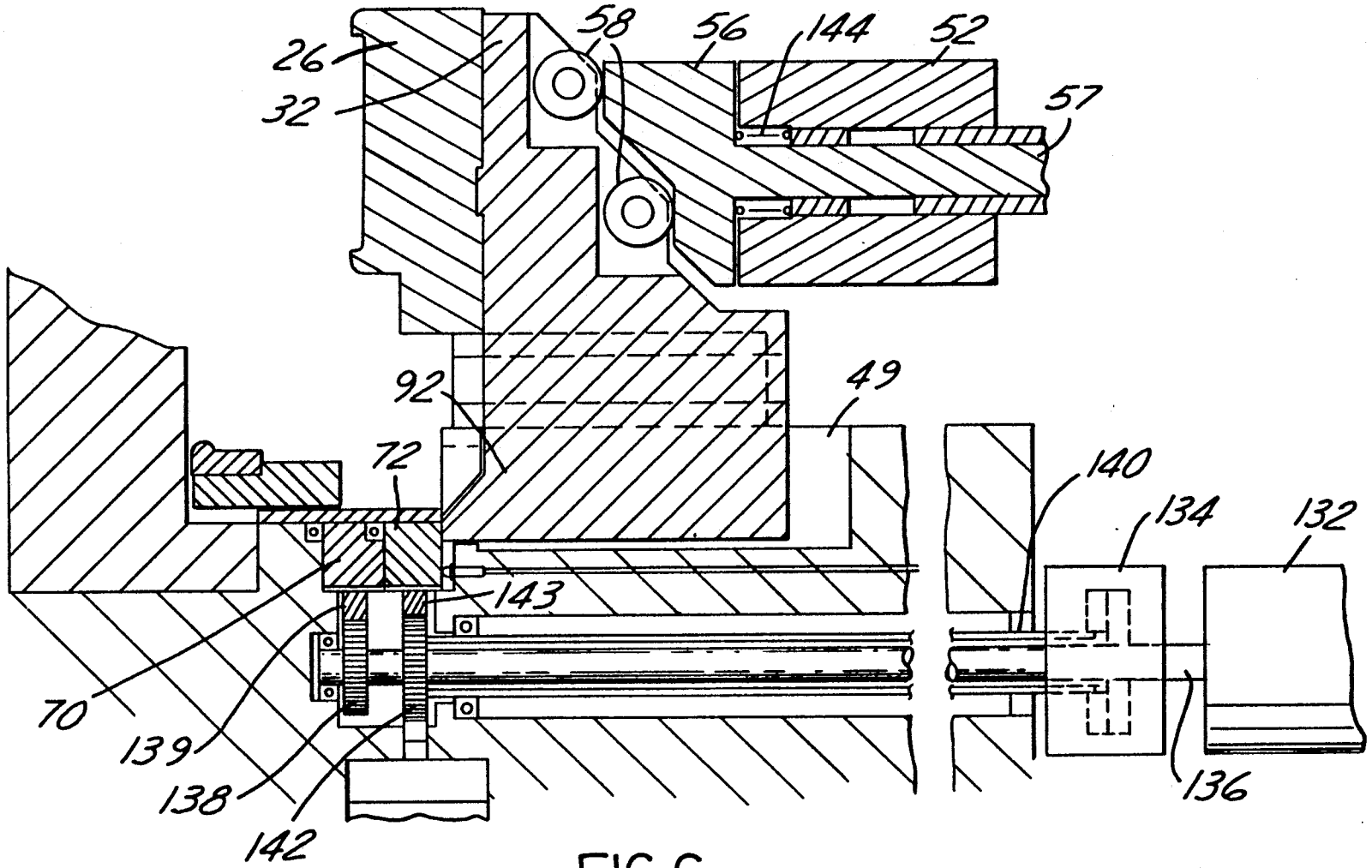
FIGS. 6–8 are fragmentary illustrations of respective additional embodiments of the invention.

FIG. 5 illustrates an external gear drive modification to the internal gear drive embodiment of FIG. 3 in which inner ring 70 is adjustable by means of belt 120, spur gear 104, bearing 102, gear 100 and an external gear 98 fixed to ring 70, while outer ring 72 is adjustable by means of belt 114, gear 106, shaft 96, and gear 94 meshing with an external gear 75' fixed to ring 72. FIG. 6 illustrates a further gear drive modification to the embodiment of FIG. 3 in which dual-shaft motor 108 (FIG. 3) is replaced by a single-shaft motor 132 and an electric clutch 134. The shaft 136 of motor 132 is connected to a spur gear 138, which in turn is operatively coupled by a side gear 139 affixed to ring 70. A hollow outer shaft 140 connects clutch 134 to a gear 142 positioned beneath and coupled by a side gear 143 affixed to outer ring 72. When clutch 134 is activated, motor 132 drives both shafts 136 and 140, thereby moving both rings 70, 72. To position ring 70 alone, clutch 134 is deactivated. FIG. 6 also illustrates a modification to the lost motion cam drive of the embodiment of FIG. 3 in which shank 57 of cam block 56 is biased radially inwardly with respect to ring 52 by the coil spring 144, which thus absorbs lost motion of cam block 56 radially outwardly following abutment of finger 92 against ring 72.

Figure 7:
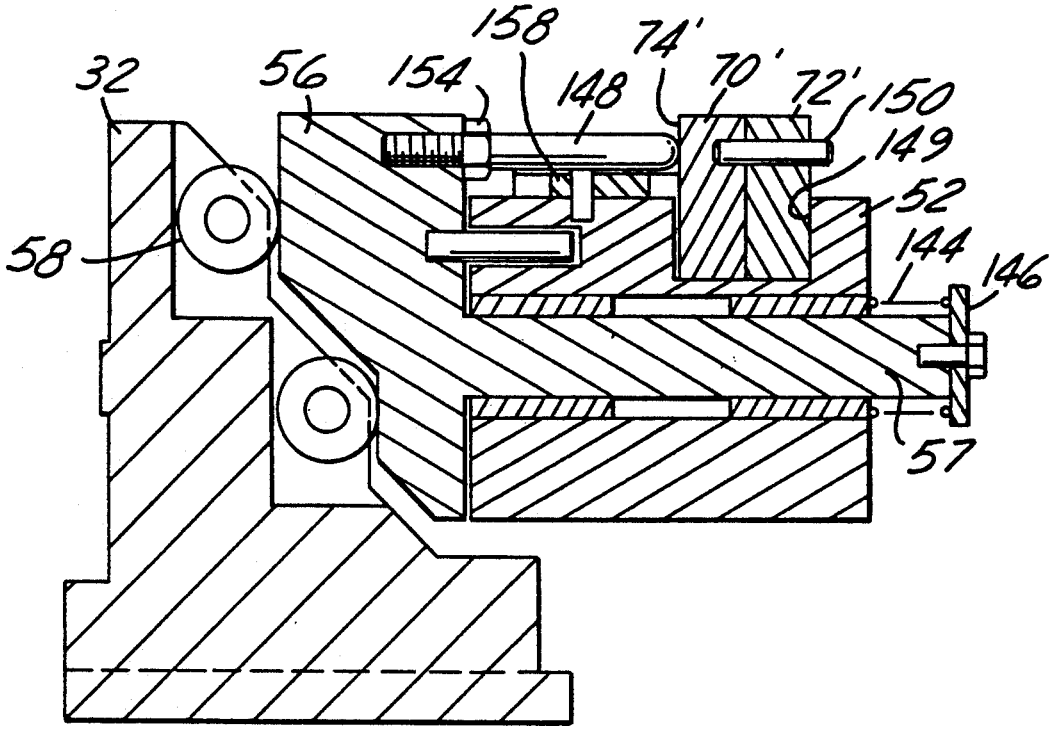
Figure 8:
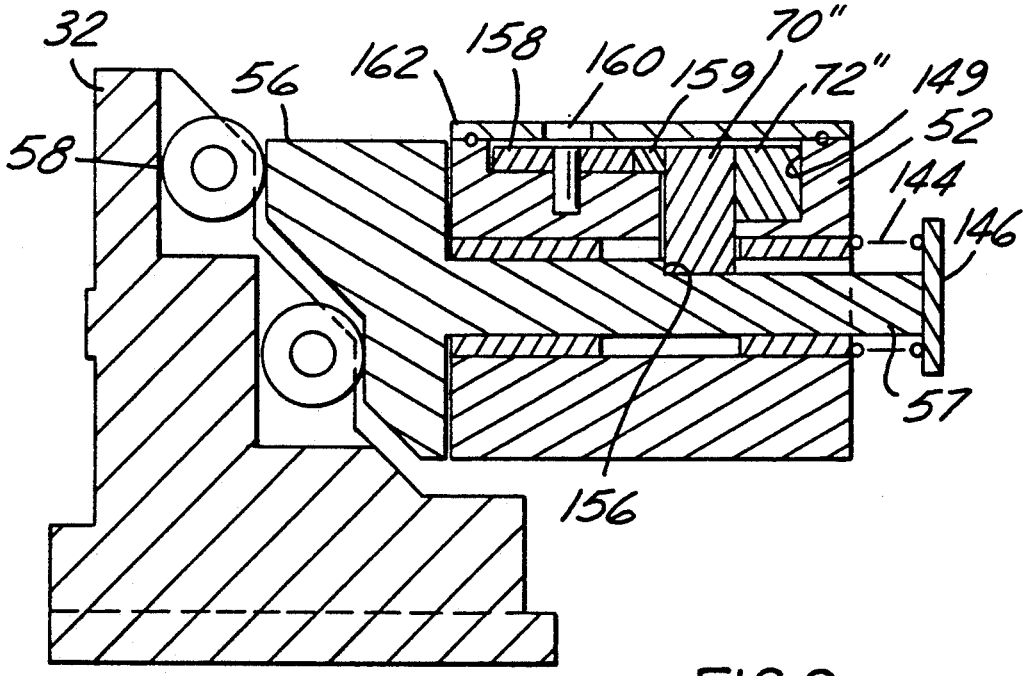

FIGS. 7 and 8 illustrate modifications in which modified adjustment rings 70', 72' are carried by actuator ring 52, rather than on die base 30, 30' as in the previous embodiments. Referring to FIG. 7, shank 57 of cam block 56 extends through actuator ring 52, and a coil spring 144 is captured in compression between the washer 146 on shank 57 and the opposing radially outer surface of actuator ring 52. A follower 148 is adjustably threadably received in cam block 56 above actuator ring 52 and extends radially outwardly therefrom parallel with shank 57. Rings 70', 72 are positioned in an annular recess or pocket 149 that extends around ring 52. Follower 148 abuts the radially inner surface 74' of ring 70', being held thereagainst by the force of spring 144. One or both of the rings 70', 72' have a circumferential series of radial holes at preselected calibrated locations, whereby the ring may be manually circumferentially positioned with respect to each other to obtain a desired concentricity or eccentricity between the average bead seat and mounting opening axes. The rings 70', 72' are then locked in such adjusted position by a pin 150 received in aligned holes in the rings. Follower 148 is locked in position by a nut 154. FIG. 7 illustrates construction for one slide 32, the construction for the remainder being identical. Thus, in the embodiment of FIG. 7, concentricity of each individual slide 32 with respect to the other slides is adjustable by means of the several follower pins 148, and concentricity/eccentricity of all slides 32 are collectively and simultaneously adjustable by rings 70', 72' as in the previous embodiments. A spur gear 158 is carried by ring 52 and engages the inner diameter of ring 70' for circumferentially adjusting position of rings 70', 72'. Pins 148 may also be employed for adjusting slides 32 to accommodate wheels of different diameter.

The modification of FIG. 8 is similar in many respects to that of FIG. 7. Adjustable follower pin 148 (FIG. 7) is replaced by a fixed shoulder 156 on shank 57. Pinion gear 158 is positioned in jacket 149 on ring 52 in engagement with opposing internal gear teeth 159 on ring 70''. Gear 158 may be manipulated by manually inserting a gear rotating hand tool through an aperture 160 in cover 162 for adjusting position of ring 70'', 72'' about the machine axis. Cover 162 engages seals 164 on ring 52 to help prevent collection of dirt and debris around rings 70'', 72'' and gear 158.

I claim:

1. Apparatus for forming at least one mounting opening in a vehicle wheel that includes a rim portion and a disc portion within said rim portion, said apparatus comprising:

a circumferential series of locating means for engaging and locating the rim portion of a wheel, means reciprocable for forming at least one mounting opening on a first axis in the disc portion of a wheel engaged by said locating means, means for selectively moving said locating means between a first position and a second position radially inward of said first position in which said locating means engage and clamp the rim portion of a wheel positioned within said locating means, and ring means surrounding said first axis and operable to define with said moving means said second position of said locating means, said ring means having a surface facing radially outwardly of said first axis spaced radially from said moving means at said first position of said locating means and positioned for abutment with said moving means at said second position of said locating means, said surface having a second axis at a predefined position with respect to said first axis.

2. The apparatus set forth in claim 1 wherein said moving means includes means for resiliently holding said moving means in abutting engagement with said ring means in said second position of said locating means.

3. The apparatus set forth in claim 1 wherein said moving means includes means for resiliently absorbing lost motion at said moving means following abutment of said moving means against said ring means.

4. The apparatus set forth in claim 1 wherein said ring means comprises an inner ring having a radially outwardly facing surface surrounding said first axis and itself having a central axis that is eccentric to said first axis, and an outer ring having a radially inwardly facing surface in engagement with said radially outwardly facing surface of said inner ring and a radially outwardly facing surface having a central axis that is eccentric to said central axis of said outer surface of said inner ring.

5. The apparatus set forth in claim 1 wherein said ring means includes means for adjustably positioning said second axis with respect to said first axis concentric with or eccentric to said first axis by adjustably positioning said radially outwardly facing surface of said ring means and thereby adjusting said second position of all said locating means simultaneously.

6. The apparatus set forth in claim 1 wherein said moving means comprises at least one fluid cylinder coupled to said locating means.

7. The apparatus set forth in claim 1 wherein said moving means comprises die means coupled to said reciprocable means and cam means coupling said die means to said locating means such that reciprocation of said reciprocable means and said die means cams all of said locating means substantially simultaneously between said first and second positions.

8. Apparatus for forming at least one mounting opening in a vehicle wheel that includes a rim portion and a disc portion within said rim portion, said apparatus comprising:

a circumferential series of locating means for engaging and locating the rim portion of a wheel, means reciprocable for forming at least one mounting opening on a first axis in the disc portion of a wheel engaged by said locating means, means for selectively moving said locating means between a first position and a second position radially inward of said first position in which said locating means engage and clamp the rim portion of a wheel positioned within said locating means, and ring means surrounding said first axis and operable to define with said moving means said second position of said locating means, said ring means being movable circumferentially of said first axis for adjusting said second position of all of said location means simultaneously, said ring means comprising an inner ring having a radially outwardly facing surface surrounding said first axis and itself having a central axis that is eccentric to said first axis, and an outer ring having a radially inwardly facing surface in engagement with said radially outwardly facing surface of said inner ring and a radially outwardly facing surface having a central axis that is eccentric to said central axis of said outer surface of said inner ring.

9. The apparatus set forth in claim 8 wherein said outer surface of said outer ring is positioned for abutment with said moving means such that position of said central axis of said outer surface of said outer ring defines a central axis of said locating means.

10. The apparatus set forth in claim 8 further comprising means for adjustably positioning said inner and outer rings about their respective central axes independently of each other.

11. The apparatus set forth in claim 10 wherein said ring-positioning means comprises first and second motor means respectively coupled to said rings.

12. The apparatus set forth in claim 11 wherein said ring-positioning means further comprises means responsive to an operator for actuating said first and second motor means independently of each other for selectively positioning said central axis of said outer surface of said outer ring at a position with respect to said first axis desired by the operator.

13. The apparatus set forth in claim 12 wherein said ring-positioning means further comprises means coupled to said outer ring for indicating position of said central axis of said outer surface of said outer ring with respect to said first axis.

14. The apparatus set forth in claim 13 wherein said position-indicating means comprises a pair of sensors operating coupled to said outer ring and positioned at 90° spacing to each other with respect to said first axis.

15. The apparatus set forth in claim 13 wherein said first and second motor means comprises electric motor means and means operatively coupling said electric motor means to said rings.

16. The apparatus set forth in claim 15 wherein said electric motor means comprises an electric motor having first and second output shafts, and means independently coupling each of said shafts to an associated one of said rings.

17. The apparatus set forth in claim 15 wherein said electric motor means comprises an electric motor having an output shaft, a second shaft adjacent to said first shaft, a clutch for operatively coupling said second shaft, said output shaft, and means independently coupling each of said shafts to an associated one of said rings.

18. The apparatus set forth in claim 8 wherein eccentricity of said central axis of said outer surface of said outer ring with respect to said central axis of said outer surface of said inner ring is substantially equal to eccentricity of said central axis of said outer surface of said inner ring with respect to said first axis.

19. Apparatus for forming at least one mounting opening in a vehicle wheel that includes a rim portion and a disc portion within said rim portion, said apparatus comprising:

a plurality of locating means disposed in a circumferential array for engaging the rim portion of a wheel within said locating means, means for forming at least one mounting opening on a first axis in the disc portion of a wheel engaged by said locating means, means for selectively moving said locating means into radial engagement with the rim portion of a wheel disposed within said locating means such that said locating means and said rim portion are positioned on a second axis, and means for adjustably positioning said second axis with respect to said first axis comprising a pair of radially internested rings, positioned for radial abutment with said moving means, a first of said rings having a radially outwardly facing surface at first eccentricity with respect to said first axis, a second of said rings having a radially inwardly facing surface operatively coupled to said radially outwardly facing surface of said first ring, and a radially outwardly facing surface at second eccentricity with respect to said radially inwardly facing surface of said second ring, orientation of said first and second eccentricities with respect to each other defining orientation of said second axis with respect to said first axis.

20. The apparatus set forth in claim 19 wherein said radially outwardly facing surface of such second ring is positioned for abutment with said moving means so as to define said second axis of said locating means.

21. The apparatus set forth in claim 19 wherein said means for adjustably positioning said second axis further comprises means for adjustably positioning said rings around said first axis independently of each other.

22. The apparatus set forth in claim 21 wherein said first and second eccentricities are substantially equal, such that said second axis may be adjustably positioned concentric with or eccentric to said first axis.

23. The apparatus set forth in claim 19 wherein said moving means further includes means for absorbing lost motion at said moving means with said moving means in abutment with said ring means and resiliently holding said moving means against said ring means.

24. The apparatus set forth in claim 23 wherein said moving means includes means for individually moving and absorbing lost motion at each of said plurality of locating means.

25. Apparatus for forming at least one mounting opening in a vehicle wheel that includes a rim portion and a disc portion within said rim portion, said apparatus comprising:

a circumferential series of locating means for engaging and locating the rim portion of a wheel, means reciprocable for forming at least one mounting opening on a first axis in the disc portion of a wheel engaged by said locating means, means for selectively moving said locating means between a first position and a second position radially inward of said first position in which said locating means engage and clamp the rim portion of a wheel positioned within said locating means, and ring means surrounding said first axis and operable to define with said moving means said second position of said locating means, said ring means being movable circumferentially of said first axis for adjusting said second position of all of said location means simultaneously, said moving means including means for resiliently holding said moving means in abutting engagement with said ring means in said second position of said locating means.

26. Apparatus for forming at least one mounting opening in a vehicle wheel that includes a rim portion and a disc portion within said rim portion, said apparatus comprising:

a circumferential series of locating means for engaging and locating the rim portion of a wheel, means reciprocable for forming at least one mounting opening on a first axis in the disc portion of a wheel engaged by said locating means, means for selectively moving said locating means between a first position and a second position radially inward of said first position in which said locating means engage and clamp the rim portion of a wheel positioned within said locating means, and ring means surrounding said first axis and operable to define with said moving means said second position of said locating means, said ring means being movable circumferentially of said first axis for adjusting said second position of all of said location means simultaneously, said moving means including means for resiliently absorbing lost motion at said moving means following abutment of said moving means against said ring means.

* * * * *